US010391780B2

(12) United States Patent
Takenaga

(10) Patent No.: US 10,391,780 B2
(45) Date of Patent: Aug. 27, 2019

(54) INKJET RECORDING APPARATUS

(71) Applicant: CANON KABUSHIKI KAISHA, Tokyo (JP)

(72) Inventor: Ken Takenaga, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/893,052

(22) Filed: Feb. 9, 2018

(65) Prior Publication Data

US 2018/0244069 A1 Aug. 30, 2018

(30) Foreign Application Priority Data

Feb. 28, 2017 (JP) ..... 2017-037738

(51) Int. Cl.

| | |
|---|---|
| ***B41J 2/17*** | (2006.01) |
| ***B41J 2/165*** | (2006.01) |
| ***B41J 2/175*** | (2006.01) |
| ***B41J 2/185*** | (2006.01) |

(52) U.S. Cl.

CPC ..... *B41J 2/185* (2013.01); *B41J 2/16505* (2013.01); *B41J 2/1721* (2013.01); *B41J 2/17563* (2013.01); *B41J 2/17596* (2013.01); *B41J 2002/1856* (2013.01)

(58) Field of Classification Search

CPC ..... B41J 2/185; B41J 2/17563; B41J 2/1721; B41J 2/16505; B41J 2/17596; B41J 2002/1856

See application file for complete search history.

(56) References Cited

U.S. PATENT DOCUMENTS

2015/0375511 A1* 12/2015 Obata ..... B41J 2/175 347/31

FOREIGN PATENT DOCUMENTS

JP 2016190361 A 11/2016

* cited by examiner

*Primary Examiner* — Bradley W Thies
(74) *Attorney, Agent, or Firm* — Canon U.S.A., Inc. IP Division

(57) ABSTRACT

An inkjet recording apparatus includes a recording head having an ejection port surface provided with ejection ports for ejecting ink, an ink receiving portion, an ink return path, and an ink storage container that includes an ink containing chamber, an air communication port, and a buffer chamber located below the ink containing chamber and provided between the ink containing chamber and the air communication port. The recording head performs a recording operation. The ink receiving portion receives the ink ejected from the ejection ports. The ink containing chamber contains ink to be supplied to the recording head. The air communication port communicates with air. The ink storage container is integrally formed with a buffer chamber that can temporarily retain ink. The ink return path connects the ink receiving portion and the buffer chamber and causes the ink to be returned from the ink receiving portion to the buffer chamber.

14 Claims, 9 Drawing Sheets

INKJET RECORDING APPARATUS

BACKGROUND OF THE INVENTION

Field of the Invention

The present disclosure relates to an inkjet recording apparatus.

Description of the Related Art

An inkjet recording apparatus discussed in Japanese Patent Application Laid-Open No. 2016-190361 includes ink tanks each including an inlet through which ink can be injected by a user. The ink injected into each ink tank is supplied to a recording head through a tube or the like.

However, in the configuration discussed in Japanese Patent Application Laid-Open No. 2016-190361, all the ink that is suctioned in a state where the recording head is sealed with a cap for maintenance of the recording head is received in a waste ink box as waste ink. Since the ink is discharged every time the ink is suctioned from the recording head as described above, a large amount of waste ink may be generated depending on suction conditions.

SUMMARY OF THE INVENTION

The present disclosure is directed to an inkjet recording apparatus capable of reducing the amount of ink to be wasted.

According to an aspect of the present invention, an inkjet recording apparatus includes a recording head having an ejection port surface provided with a plurality of ejection ports for ejecting ink, and configured to perform a recording operation, an ink receiving portion configured to receive the ink ejected from the plurality of ejection ports, an ink storage container including an ink containing chamber configured to contain ink to be supplied to the recording head, an air communication port configured to communicate with air, and a buffer chamber that can temporarily retain ink, located below the ink containing chamber and provided between the ink containing chamber and the air communication port, the ink containing chamber, the air communication port, and the buffer chamber being integrally formed, and an ink return path configured to connect the ink receiving portion and the buffer chamber and cause the ink to be returned from the ink receiving portion to the buffer chamber.

Further features of the present invention will become apparent from the following description of embodiments with reference to the attached drawings.

DESCRIPTION OF THE EMBODIMENTS

Embodiments of an inkjet recording apparatus will be described. However, constituent elements described in the embodiments are illustrated by way of example only and are not intended to limit the scope of the present disclosure. A serial type inkjet recording apparatus configured to perform recording by causing a recording head that ejects ink onto a recording medium, which is intermittently conveyed, to reciprocate in a direction intersecting with a conveyance direction of the recording medium is herein described by way of example. However, the present disclosure is not limited to the serial type inkjet recording apparatus. The present disclosure can also be applied to a line type inkjet recording apparatus that continuously performs printing using a long print head. The term "ink" used herein is a generic term for liquid such as recording liquid. The term "recording" used herein indicates not only recording on a planar object, but also recording on a three-dimensional object. The term "recording medium" used herein is a generic term for a recording medium onto which liquid is ejected. Examples of the recording medium include paper, cloth, a plastic film, a metallic plate, glass, ceramics, wood, and leather. The recording medium is not limited to cut paper, but also includes a roll of a continuous sheet.

Figure 1:
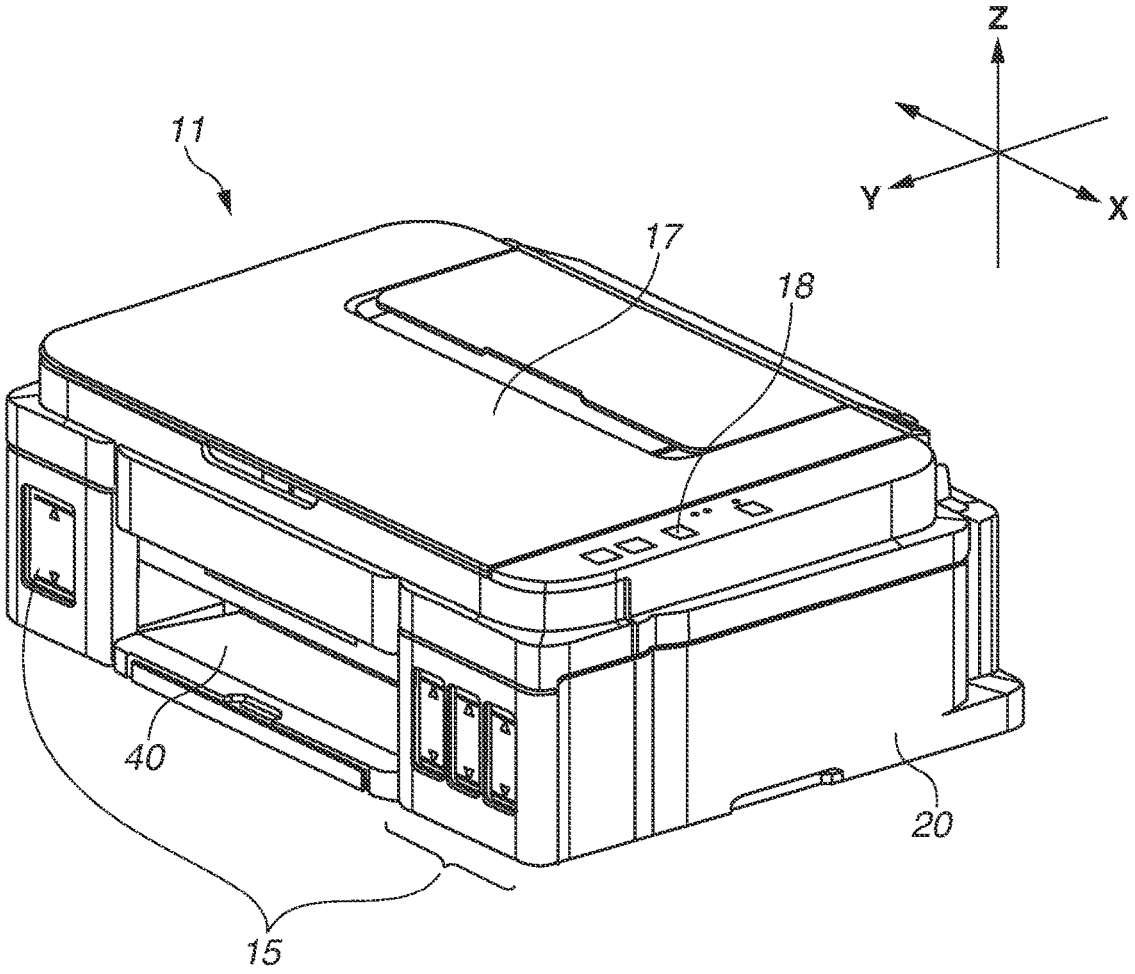
FIG. 1 is a perspective view illustrating an appearance of an inkjet recording apparatus according to a first embodiment.

FIG. 1 is a perspective view schematically illustrating an appearance of an inkjet recording apparatus (hereinafter, referred to as a "recording apparatus") 11 according to a first embodiment. As illustrated in FIG. 1, the recording apparatus 11 includes a housing (outer-casing portion) 20, a recording head 13 (see FIG. 2) that performs a recording operation on a recording medium (not illustrated), and an ink tank 15 serving as an ink storage container that contains ink to be supplied to the recording head 13. In the present embodiment, the ink tank 15 is disposed on a front surface of the housing 20. The recording apparatus 11 also includes a scanner unit 17 that performs a document reading operation, and an operation input unit 18 that allows a user to perform an operation such as inputting of an instruction. The scanner unit 17 and the operation input unit 18 are provided at an upper portion of the housing 20.

Figure 2:
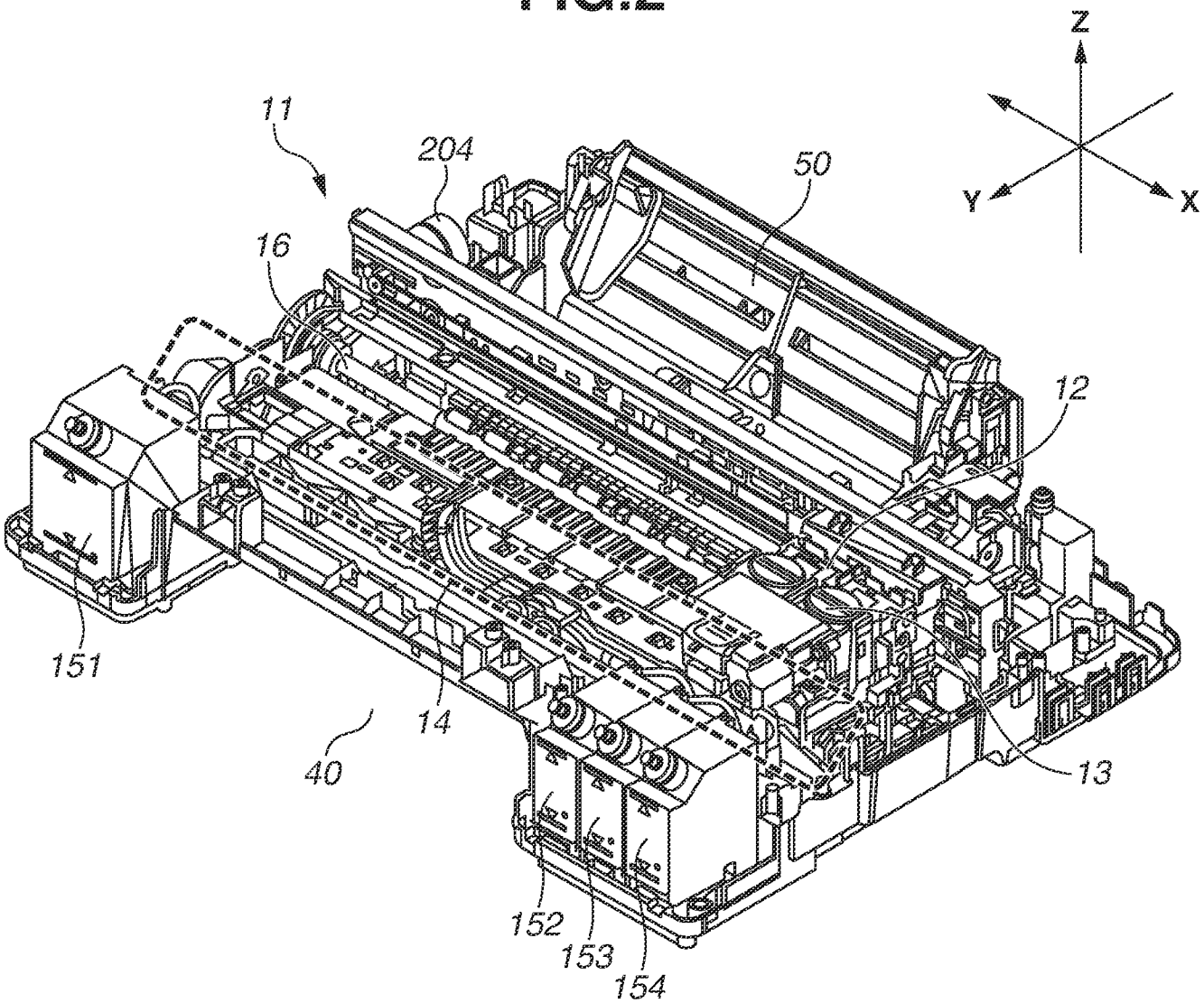
FIG. 2 is a perspective view illustrating an internal configuration of the inkjet recording apparatus according to the first embodiment.

FIG. 2 is a perspective view illustrating an internal configuration of the recording apparatus 11. The recording apparatus 11 includes a feeding unit 50 that feeds a recording medium, a conveyance roller 16 that conveys the recording medium, and a discharge unit 40 (see FIG. 1) that discharges the recording medium. The recording medium is fed into the recording apparatus 11 from the feeding unit 50 by rollers (not illustrated). While the fed recording medium is conveyed by the conveyance roller 16, the recording head 13 performs the recording operation on the recording medium. The recording medium on which the recording operation has been performed is discharged from the discharge unit 40 to the outside of the recording apparatus 11. The recording apparatus 11 also includes a maintenance portion for the recording head 13, a main chassis, a timing belt, and a carriage motor 204.

A carriage 12 is supported by the main chassis and driven by the carriage motor 204 through the timing belt, to thereby move along a main scanning direction intersecting with the conveyance direction (Y-direction) of the recording medium. In the present embodiment, the conveyance direction and the main scanning direction are perpendicular to each other. The recording head 13 is mounted on the carriage 12. The recording head 13 ejects ink droplets while moving in the main scanning direction, and performs the recording operation for recording an image corresponding to one band on the recording medium. When the image corresponding to one band is recorded on the recording medium, the recording medium is conveyed in the conveyance direction by a predetermined amount by the conveyance roller 16 (intermittent conveyance operation). The recording operation corresponding to one band and the intermittent conveyance operation are repeatedly performed to thereby record the image on the entire recording medium.

The maintenance portion is provided within a movement area in the main scanning direction of the carriage 12. The maintenance portion includes a maintenance unit that performs maintenance processing on the recording head 13, and is disposed at a position where the maintenance portion can face an ejection port surface 131 (see FIG. 3) of the recording head 13. The maintenance unit includes a cap for capping the ejection port surface 131. The maintenance unit also includes a suction mechanism or the like for performing a suction operation for removing residual bubbles and thickened ink within each ejection port by suctioning the ink in a state where the maintenance unit is capped with the cap. The maintenance unit includes a mechanism for receiving ink ejected by a preliminary discharge operation for preliminarily ejecting the ink from the ejection port. The capping operation, the suction operation, and the preliminary discharge operation are collectively referred to as maintenance processing. The ejection performance of the recording head 13 is maintained by the maintenance processing performed by the maintenance unit.

Figure 3:
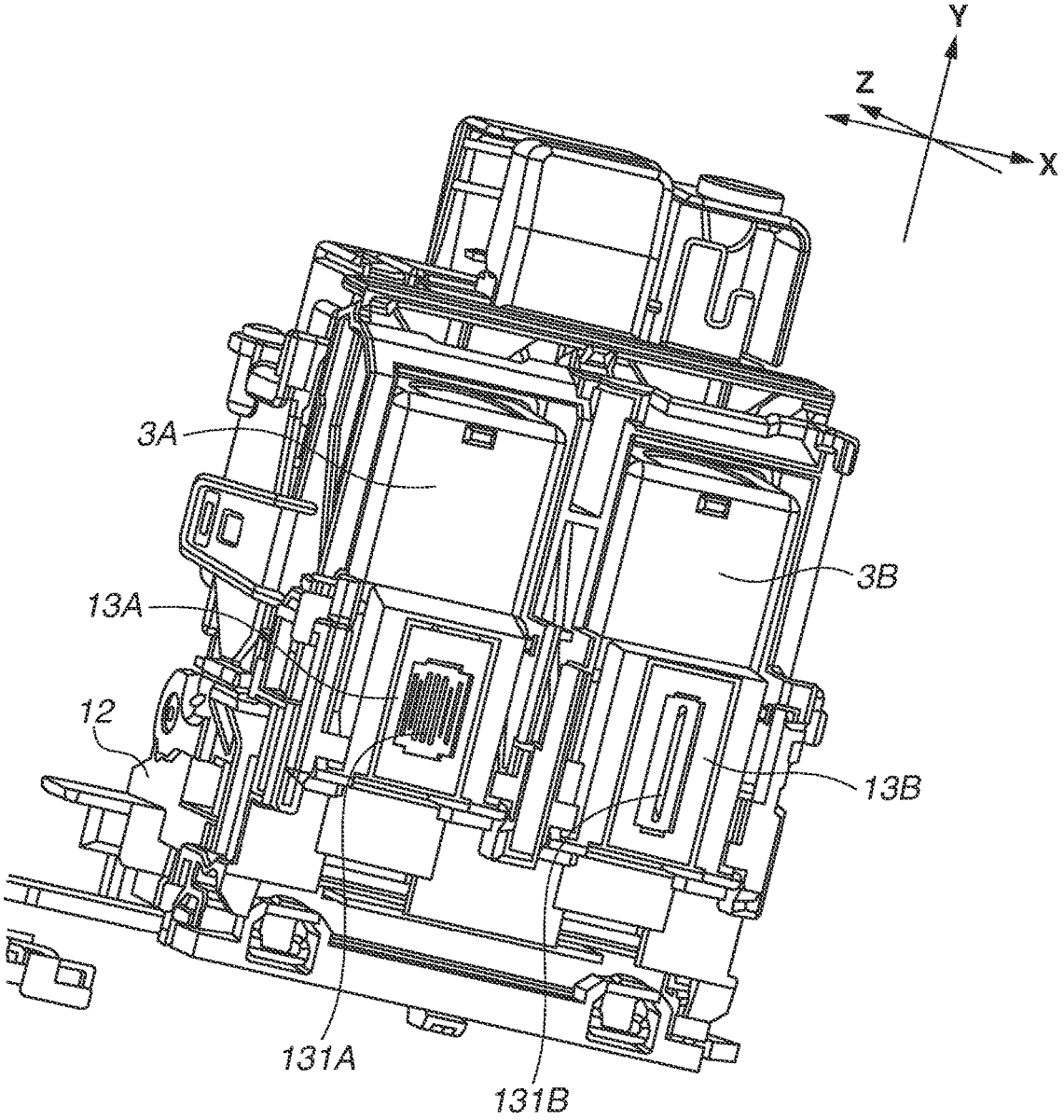
FIG. 3 is a perspective view illustrating a side of a carriage that faces a recording medium according to the first embodiment.

FIG. 3 is a perspective view illustrating a side of the carriage 12 that has the recording head 13 mounted thereon and faces the recording medium. In other words, FIG. 3 is a perspective view of the carriage 12 having the recording head 13 mounted thereon as viewed from below. As illustrated in FIG. 3, a color cartridge 3A and a black cartridge 3B are mounted side by side in the main scanning direction on the carriage 12. The color cartridge 3A has a configuration in which a color recording head 13A and a color ink reservoir portion (not illustrated) are integrally formed. Similarly, the black cartridge 3B has a configuration in which a black recording head 13B and a black ink reservoir portion (not illustrated) are integrally formed. The color recording head 13A includes a color ejection port surface 131A on which an ejection port array for ejecting three colors of ink, i.e., cyan ink (C), magenta ink (M), and yellow ink (Y), is provided for each color. The black recording head 13B includes a black ejection port surface 131B on which an ejection port array for ejecting black ink is provided.

As illustrated in FIG. 2, the recording apparatus 11 includes an ink flow path 14 corresponding to each color of ink. The recording head 13 and the ink tank 15 are connected for each color by the ink flow path 14. A black ink tank 151 is provided on the left side of the discharge unit 40 as viewed from the front side of the recording apparatus 11. A cyan ink tank 152, a magenta ink tank 153, and a yellow ink tank 154 are provided on the right side of the discharge unit 40. The four ink tanks are collectively referred to as the ink tank 15. The ink reservoir portions corresponding to the respective colors and are respectively included in the color cartridge 3A and the black cartridge 3B temporarily store the ink supplied from the ink tank 15 through the ink flow path 14.

FIGS. 4A to 4D are sectional diagrams each schematically illustrating a flow of black ink supplied from the ink tank 15 to the recording head 13. In FIGS. 4A to 4D, a downstream side in the conveyance direction (Y-direction) is hereinafter also referred to as a front side, and an upstream side in the conveyance direction (Y-direction) is hereinafter also referred to as a back side. An inlet 21 through which the user injects ink is provided on an inclined surface of the ink tank 15 that is located on the front side of an upper portion thereof. A tank cap 22 is detachably attached to the inlet 21. The user can inject ink into the ink tank 15 from the inlet 21 by detaching the tank cap 22.

An ink containing chamber 33 for containing ink is disposed at an upper portion of the ink tank 15 in a vertical direction (Z-direction), and a buffer chamber 34 that contains air is disposed at a lower portion of the ink tank 15 in the vertical direction. The inlet 21 is provided at the ink containing chamber 33. The ink containing chamber 33 and the buffer chamber 34 are integrally formed in the ink tank 15 in such a manner that a ceiling surface of the buffer chamber 34 is formed of a part of a bottom surface of the ink containing chamber 33. The ink containing chamber 33 and the buffer chamber 34 are partitioned by a partition wall 36 formed of the bottom surface of the ink containing chamber 33 and the ceiling surface of the buffer chamber 34. The ink containing chamber 33 and the buffer chamber 34 are connected by a connection path 341 provided at one end (downstream side in the conveyance direction) of the partition wall 36.

A tube 51 is connected through an ink flow port 141 to the other end (upstream side in the conveyance direction) of the partition wall 36. The tube 51 is formed of a flexible member or the like. The ink flow port 141 and the tube 51 constitute the ink flow path 14. The ink contained in the ink containing chamber 33 is supplied from the ink flow port 141 to the recording head 13 through the tube 51.

An air communication port 23 that communicates with outside air is provided on the back side of the upper portion of the ink tank 15. The buffer chamber 34 is connected to the air communication port 23. When a valve is in an opened state, the buffer chamber 34 communicates with the air. On the other hand, when the valve 24 is in a closed state, the buffer chamber 34 does not communicate with the air. Since the buffer chamber 34 is also connected to the ink containing chamber 33, when the buffer chamber 34 communicates with the air, the ink containing chamber 33 also communicates with the air. Similarly, when the buffer chamber 34 does not communicate with the air, the ink containing chamber 33 does not communicate with the air.

Figure 4A:
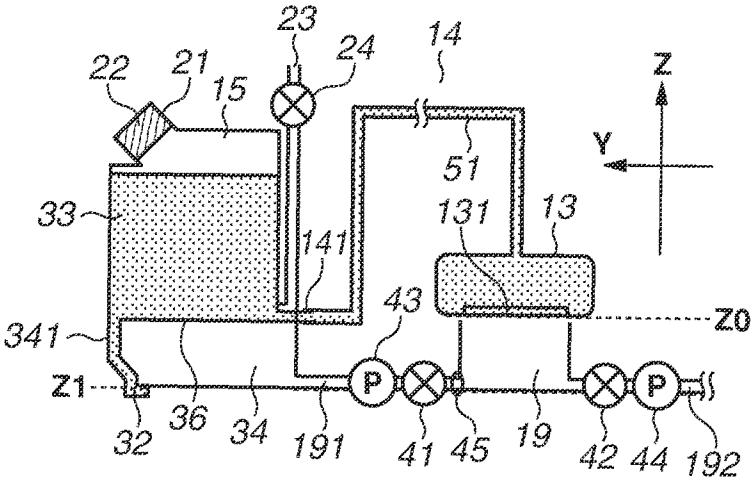
FIGS. 4A to 4D are sectional views schematically illustrating a flow of ink supplied from an ink tank to a recording head of the inkjet recording apparatus according to the first embodiment.

FIG. 4A illustrates a first state where ink is filled in a space ranging from the ink tank 15 to the recording head 13 and the recording operation to be performed by the recording head 13 is ready. In the first state, the inlet 21 is sealed with the tank cap 22, and the space ranging from the ink containing chamber 33 to the recording head 13 is filled with ink. When the recording operation is performed, the valve 24 is opened to allow the ink containing chamber 33 and the buffer chamber 34 to communicate with the air.

The supply of ink from the ink containing chamber 33 to the recording head 13 during the recording operation is performed by a water head difference system using a water head difference of an ink liquid surface. In the vertical direction, the height of the ejection port surface 131 is represented by Z0, and the height of a boundary plane 32 between the air and the ink liquid surface in the buffer chamber 34 is represented by Z1. When the height (Z0) of the ejection port surface 131 is set to be higher than the height (Z1) of the boundary plane 32, a negative pressure is applied to the inside of each ejection port formed on the ejection port surface 131. This negative pressure prevents leakage of the ink from the ejection port. In the first state, an opening where the connection path 341 and the buffer chamber 34 are connected is designed small enough to work towards preventing an ink meniscus from being broken so that the height of the boundary plane 32 can be maintained at the same height as that of the bottom surface of the buffer chamber 34.

When the ink contained in the ink containing chamber 33 is consumed by the recording operation or the like, the air having the same volume as that of the consumed ink is introduced into the ink containing chamber 33. In the present embodiment, the air is supplied from the air communication port 23 to the buffer chamber 34, and the air contained in the buffer chamber 34 is introduced from the boundary plane 32 into the ink containing chamber 33.

In addition, the buffer chamber 34 can temporarily store the ink that is pushed out from the ink containing chamber 33 through the connection path 341 when the air in the ink containing chamber 33 is expanded due to a pressure variation or a temperature variation. The ink temporarily stored in the buffer chamber 34 is returned to the ink containing chamber 33 by a negative pressure generated by the ink supply of the water head difference system in the recording operation. The buffer chamber 34 has a sufficient volume for storing the ink pushed out from the ink containing chamber 33. In this way, the provision of the buffer chamber 34 between the air communication port 23 and the ink containing chamber 33 can prevent leakage of the ink from the air communication port 23.

The recording apparatus 11 is further provided with an ink receiving portion 19 that receives the ink ejected from the recording head 13. The ink receiving portion 19 is, for example, a black cap that constitutes the maintenance unit, which is described above, and receives the ink discharged by the suction operation or the like. The ink receiving unit is not limited to a cap, and may be any member as long as the member can receive the ink ejected or suctioned from the recording head 13.

In the present embodiment, an ink return path 191 that connects the ink receiving portion 19 and the buffer chamber 34 is provided. A return valve (first valve) 41 and a first pump 43 are provided in the middle of the ink return path 191. The return valve 41 is a valve that is switchable between an opened state where the ink return path 191 is opened and a closed state where the ink return path 191 is closed. When the return valve 41 is in the opened state and the first pump 43 is driven, the ink return path 191 is opened and the ink received by the ink receiving portion 19 is returned to the buffer chamber 34.

A filter 45 is provided as a filtration mechanism between the ink receiving portion 19 and the return valve 41. The ink receiving portion 19 receives the ink ejected or suctioned from the recording head 13 by a plurality of types of maintenance processing such as a preliminary ejection operation and a suction recovery operation. Accordingly, both the ink that can be used for recording and the ink that is not suitable for recording are received by the ink receiving portion 19. Considering that these different types of ink are mixed in the ink receiving portion 19, the filter 45 is configured to remove impurities and the like from the ink to be returned to the buffer chamber 34. The position where the filter 45 is provided is not limited to the position described above. The filter 45 can be provided at any position as long as the filter 45 is located between the ink receiving portion 19 and the ink containing chamber 33.

The ink receiving portion 19 is also connected to a waste liquid tank, which is not illustrated, through an ink discharge path 192. A discharge valve (second valve) 42 and a second pump 44 are provided in the middle of the ink discharge path 192. The discharge valve 42 is a valve that is switchable between an opened state where the ink discharge path 192 is opened and a closed state where the ink discharge path 192 is closed. When the discharge valve 42 is in the opened state and the second pump 44 is driven, the ink discharge path 192 is opened and the ink received by the ink receiving portion 19 is discharged into the waste liquid tank.

Figure 4B:
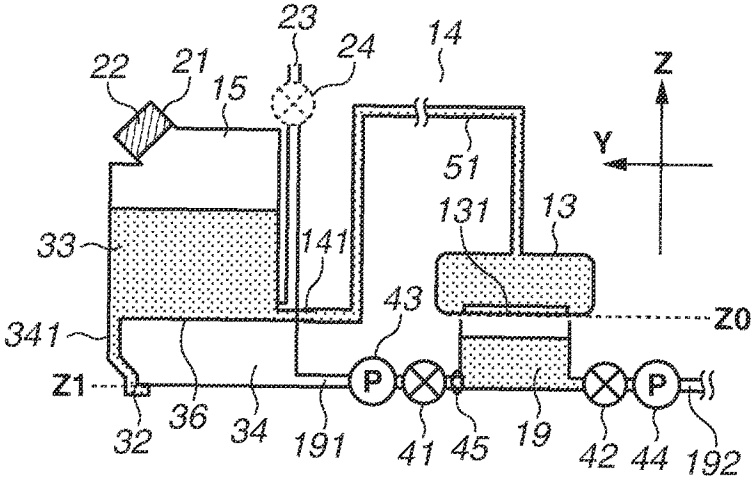

FIG. 4B illustrates a second state where ink is accumulated in the ink receiving portion 19. The ink receiving portion 19 receives ink when, for example, the ink that does not contribute to the recording operation is preliminarily ejected from the recording head 13. Also, when the suction recovery operation is performed on the recording head 13, the ink suctioned from each ejection port is accumulated in the ink receiving portion 19.

Figure 4C:
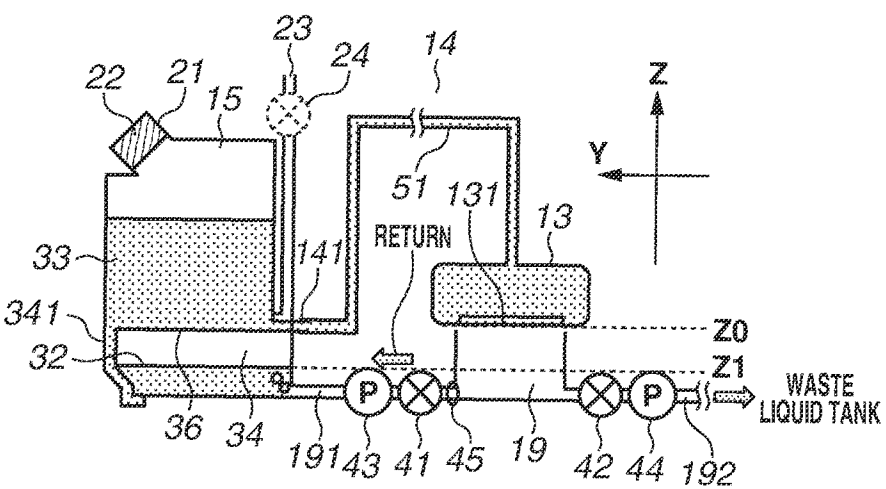

FIG. 4C illustrates a third state where the return valve 41 is in the opened state and the first pump is driven to return the ink from the ink receiving portion 19 to the buffer chamber 34. When the first pump 43 is stopped to bring the return valve 41 into the closed state, the ink return path 191 is closed. This prevents the ink returned to the buffer chamber 34 by the first pump 43 from flowing back to the ink receiving portion 19. The provision of the return valve 41 and the first pump 43 as described above allows an arbitrary amount of ink to be returned to the buffer chamber 34, or allows ink to be returned to the buffer chamber 34 at any timing. Accordingly, for example, part of the ink received by the ink receiving portion 19 can be returned to the buffer chamber 34 and the remaining ink can be discharged into the waste liquid tank, and vice versa.

In the present embodiment, the buffer chamber 34 is located vertically below the ink containing chamber 33. Accordingly, even in the third state illustrated in FIG. 4C, the height (Z1) of the boundary plane 32 between the ink and the air is lower than the height (Z0) of the ejection port surface 131. Therefore, the water head difference can be maintained between the recording head 13 and the ink containing chamber 33. In this manner, the buffer chamber 34 is provided below the ink containing chamber 33 and the boundary plane 32 between the ink and the air is set to be lower than the ejection port surface 131, so that the recording head 13 can be disposed at a lower position within the recording apparatus 11. This contributes to the downsizing of the entire recording apparatus 11.

Figure 4D:
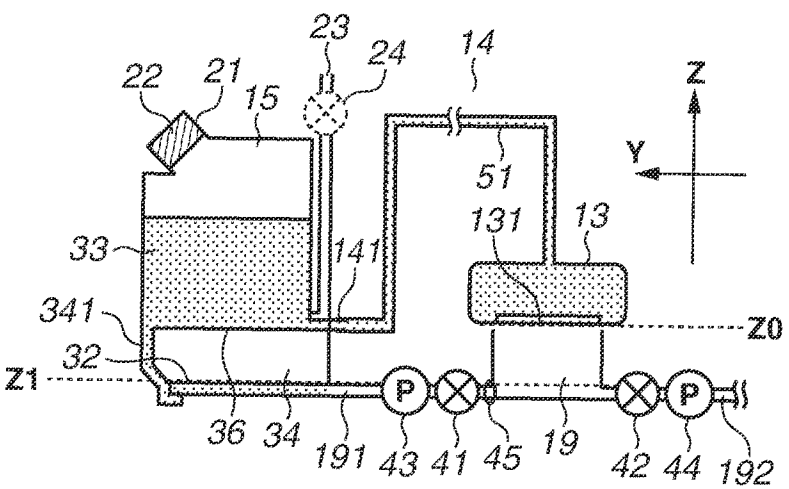

FIG. 4D illustrates a fourth state where the recording operation is performed by the recording head 13, while the ink returned to the buffer chamber 34 is introduced into the ink containing chamber 33. Since the ink is supplied using the water head difference system as described above, when ink is ejected from the recording head 13, the ink contained in the buffer chamber 34 is returned into the ink containing chamber 33 due to a negative pressure.

In this case, the connection path 341 that connects the ink containing chamber 33 and the buffer chamber 34 is disposed at a position separated from the ink flow port 141. The connection path 341 and the ink flow port 141 are disposed in such a manner that the ink returned from the ink receiving portion 19 through the connection path 341 is prevented from being directly supplied from the ink flow port 141 to the recording head 13, thereby obtaining an ink stirring effect in the ink containing chamber 33. The configuration in which the ink returned from the ink receiving portion 19 is easily stirred with the ink contained in the ink containing chamber 33 can maintain the quality of the ink.

While FIG. 4C illustrates a case where ink is returned from the ink receiving portion 19 to the buffer chamber 34, the ink may be discharged into the waste liquid tank depending on the state of the ink. For example, when the ink that contacts the air for a long period at the ejection port surface 131 is received at the ink receiving portion 19, it is highly likely that the ink has high viscosity. Accordingly, the discharge valve 42 is brought into the opened state and the second pump 44 is driven to discharge the ink into the waste liquid tank. In this way, two flow paths (the ink return path 191 and the ink discharge path 192) are provided for one ink receiving portion 19, which makes it possible to select whether to recycle or discard the ink received by the ink receiving portion 19. The operation for controlling the return valve and the discharge valve 42 according to the present embodiment will be described in detail below.

Figure 5:
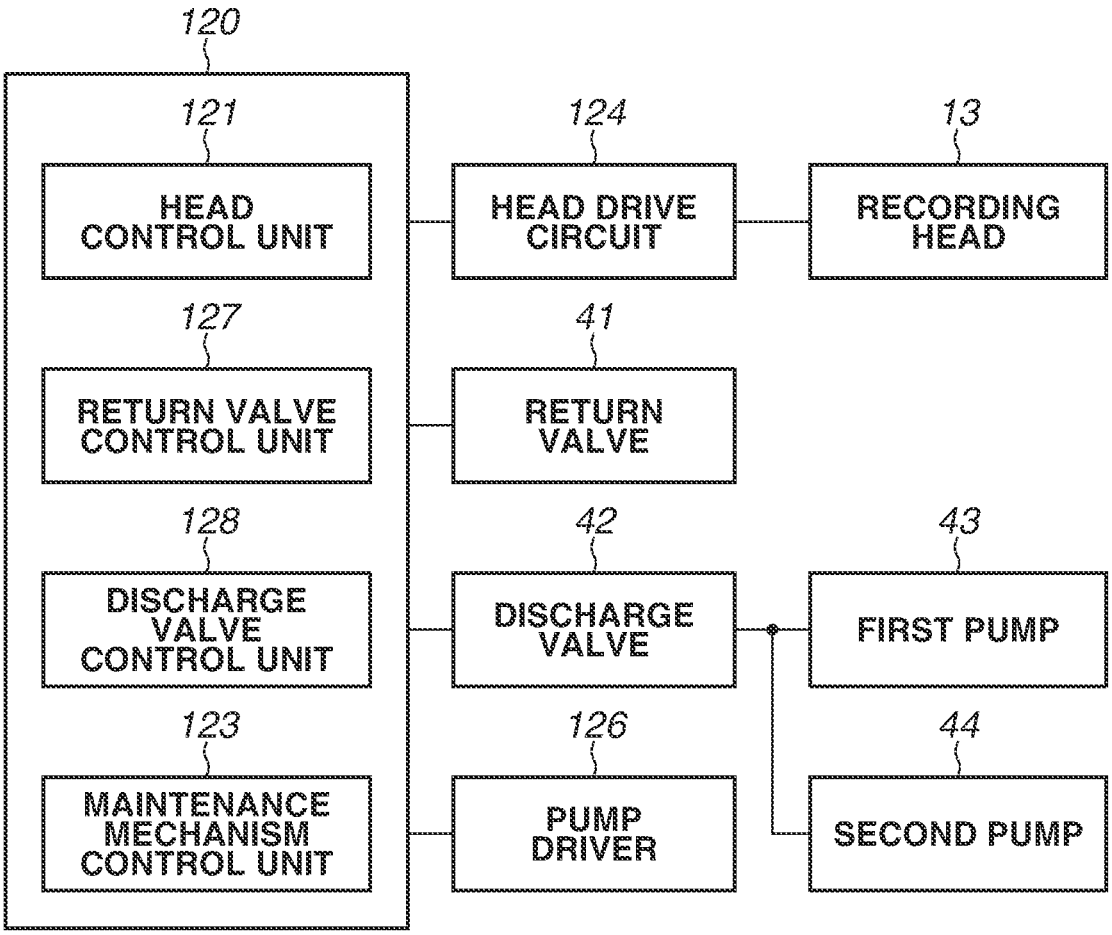
FIG. 5 is a block diagram illustrating units for controlling the inkjet recording apparatus according to the first embodiment.

FIG. 5 is a block diagram illustrating units for controlling the recording apparatus 11. The recording apparatus 11 includes a control unit 120 including a central processing unit (CPU), which is an arithmetic processing unit, a read only memory (ROM) that stores control programs executed by the CPU and data used for the control programs, and a random access memory (RAM) for temporarily storing data during execution of programs.

The control unit 120 includes a head control unit 121, a return valve control unit 127, a discharge valve control unit 128, and a maintenance mechanism control unit 123. When the control unit 120 receives a printing instruction from a host apparatus, the head control unit 121 controls a head drive circuit 124 to cause the recording head 13 to eject ink to perform the recording operation. The return valve control unit 127 controls opening and closing of the return valve 41. The discharge valve control unit 128 controls opening and closing of the discharge valve 42. The maintenance mechanism control unit 123 controls a pump driver 126 to drive the first pump 43 and the second pump 44. The control unit 120 controls the discharge valve 42 to be brought into the closed state when the return valve 41 is in the opened state, and controls the return valve 41 to be brought into the closed state when the discharge valve 42 is in the opened state. In other words, the control unit 120 controls the return valve 41 and the discharge valve 42 in such a manner that both the return valve 41 and the discharge valve 42 are not brought into the opened state.

Figure 6:
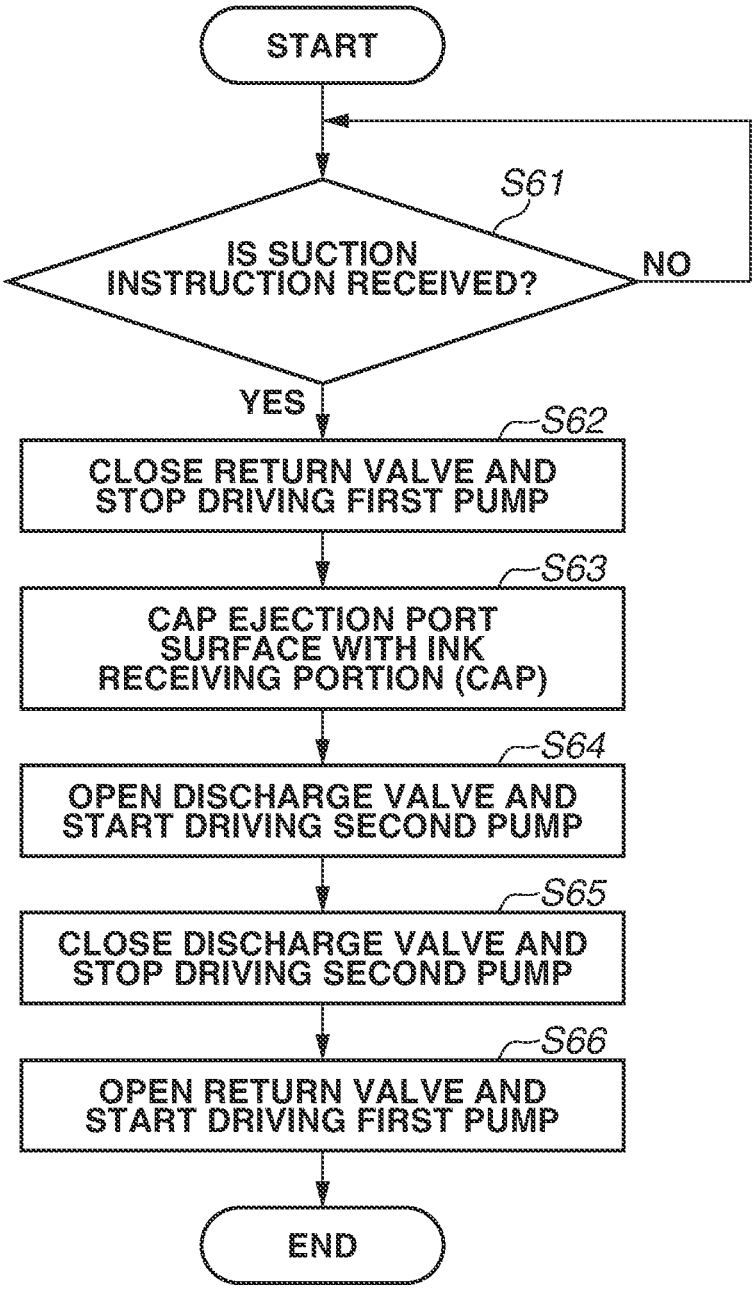
FIG. 6 is a flowchart illustrating processing for ink received by an ink receiving portion according to the first embodiment.

FIG. 6 is a flowchart illustrating processing for ink received by the ink receiving portion 19. In the present embodiment, the control unit 120 generally brings the return valve 41 into the opened state and drives the first pump 43 to return the ink received by the ink receiving portion 19 to the buffer chamber 34. At this time, the discharge valve 42 is in the closed state.

In step S61, the control unit 120 determines whether a suction instruction, the suction being one type of maintenance processing, is received. If the suction instruction is not received (NO in step S61), the control unit 120 controls the return valve 41 to be maintained in the opened state and controls the first pump 43 to be continuously driven. In other words, when the suction instruction is not received, the ink received by the ink receiving portion 19 is returned to the buffer chamber 34. The first pump 43 need not necessarily be driven constantly, and may be driven periodically or at a predetermined timing.

If the suction instruction is received (YES in step S61), the processing proceeds to step S62. In step S62, the control unit 120 closes the return valve 41 and stops driving the first pump 43. In step S63, the control unit 120 causes the ejection port surface 131 to be capped with the ink receiving portion (cap) 19. In step S64, the control unit 120 brings the discharge valve 42 into the opened state and starts the suction operation by the second pump 44. As a result, the ink supplied from each ejection port of the ejection port surface 131, which is capped with the ink receiving portion 19, is suctioned and the suctioned ink is discharged into the waste liquid tank. In this way, in the present embodiment, the suction operation is carried out using the second pump 44.

After a lapse of a predetermined period, in step S65, the control unit 120 brings the discharge valve 42 into the closed state and stops the suction operation by the second pump 44. Thus, the suction operation on the recording head 13 is terminated. In step S66, the control unit 120 brings the return valve 41 into the opened state and starts (resumes) driving the first pump 43. In other words, the processing for ink is returned to the state before step S61.

As illustrated in FIG. 6, in the present embodiment, the ink suctioned by the suction operation performed in response to the suction instruction is discharged into the waste liquid tank. The suction operation is an operation for suctioning residual bubbles in each ejection port and thickened ink on the ejection port surface 131. This suction operation is performed because, if the suctioned ink is used for the recording operation, the image quality on the recording medium cannot be maintained in some cases. If maintenance is required for the ejection port surface 131, the suction instruction is generally input to the recording apparatus 11 by a driver or user.

On the other hand, the ink received by the ink receiving portion 19 through an operation other than the suction operation is returned to the buffer chamber 34. For example, the ink that is ejected to the ink receiving portion 19 in the preliminary discharge operation for ejecting the ink that does not contribute to the recording operation before, after, or during the recording operation is returned to the buffer chamber 34. When the user uses the recording apparatus 11 for the first time, the ink accumulated in the ink receiving portion 19 during an initial filling operation for filling a space ranging from the ink containing chamber 33 to the recording head 13 with ink is also returned to the buffer chamber 34. During the initial filling operation, the control unit 120 causes the ejection port surface 131 to be capped with the ink receiving portion 19 and brings the return valve 41 into the opened state to drive the first pump 43, thereby supplying ink to the recording head 13. Thus, in the present embodiment, the first pump 43 is used for the initial filling operation.

The quality of the ink received by the ink receiving portion 19 in the preliminary discharge operation or the initial filling operation is maintained at a level high enough to be usable for the recording operation in many cases. Accordingly, such ink is not discharged into the waste liquid tank, and is returned to the ink containing chamber 33, thereby reducing the amount of ink to be wasted. The sequence for selecting whether to recycle or discard the ink is not limited to this sequence.

In this manner, the ink receiving portion 19 and the buffer chamber 34 of the ink tank 15 are connected and the ink received by the ink receiving portion 19 is returned to the ink containing chamber 33, thereby allowing a reduction in the amount of ink to be wasted. In addition, the ink receiving portion 19 and the waste liquid tank are also connected to provide a configuration capable of discarding the ink, thereby allowing only the ink that has no adverse effect on the recording quality to be selectively returned to the ink containing chamber 33.

Figure 7:
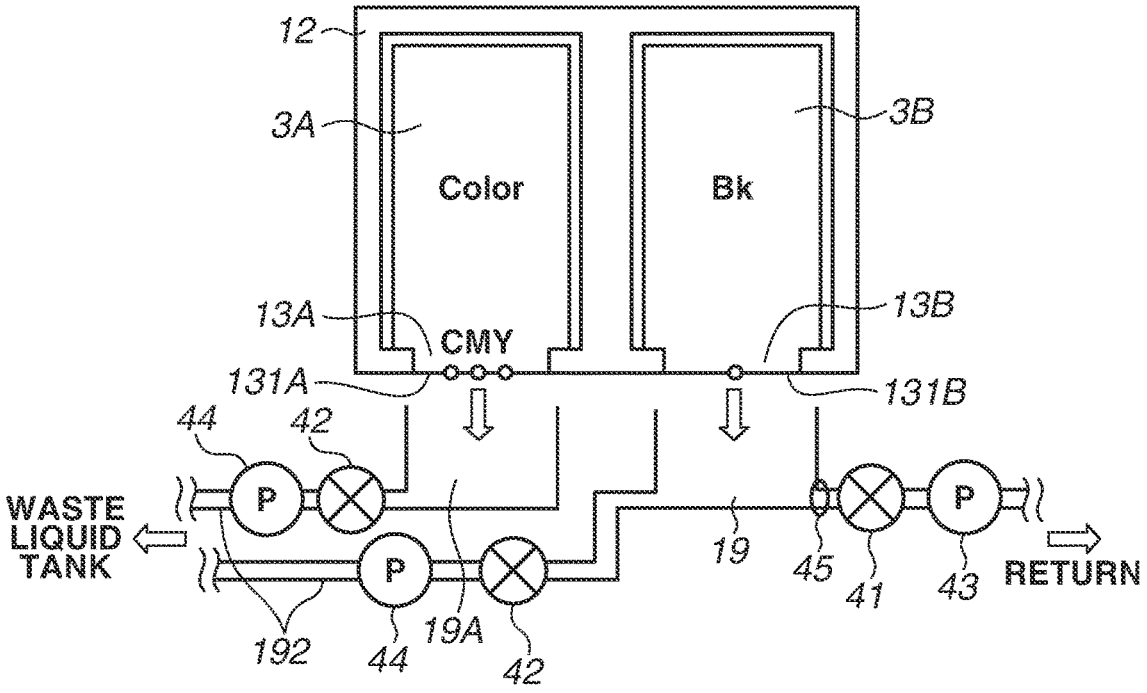
FIG. 7 is a schematic diagram illustrating details of the recording head and the ink receiving portion according to the first embodiment.

FIG. 7 is a schematic diagram illustrating details of the recording head 13 and the ink receiving portion 19 according to the present embodiment. The color recording head 13A uses the ejection port surface 131A that is common to three colors (C, M, Y) of ink, and thus a color ink receiving portion (color cap) 19A, which is different from the black ink receiving portion 19, receives ink. Accordingly, in the color ink receiving portion 19A, three colors of ink are mixed. Returning the mixed color ink to the buffer chamber 34 leads to a deterioration in the recording quality in the subsequent recording operation. For this reason, the color ink receiving portion 19A is provided with the ink discharge path 192 to discharge all the received ink into the waste liquid tank. The discharge valve 42 and the second pump 44 are provided in the middle of the ink discharge path 192, like in a black ink receiving portion. The basic configuration for supplying color ink is similar to that for black ink.

On the other hand, as for the black recording head 13B, the black ejection port surface 131B ejects only black ink, and thus mixing of different colors of ink does not occur in the ink receiving portion 19. Accordingly, like in the present embodiment, the provision of the ink return path 191 to recycle the ink allows a reduction in the amount of ink to be wasted.

While FIG. 7 illustrates an example in which the discharge valve 42 and the second pump 44 for black ink and the discharge valve 42 and the second pump 44 for color ink are separately provided, the present disclosure is not limited to this configuration. A configuration in which the discharge valve 42 and the second pump 44 are commonly used for black ink and color ink may be used. The return valve 41 and the first pump 43 are formed of different members, and the discharge valve 42 and the second pump 44 are also formed of different members. However, the present disclosure is not limited to this configuration. A member having a configuration in which a valve and a negative pressure generation unit are integrally formed may be used. The arrangement of the return valve 41 and the first pump 43 and the arrangement of the discharge valve 42 and the second pump 44 are not limited to those described in the present embodiment.

Further, in the present embodiment, the ink return path 191 is provided not only with the return valve 41, but also with the first pump 43. However, a configuration for returning ink from the ink receiving portion 19 to the buffer chamber 34 without using any pump can also be employed. When the valve 24 is brought into the closed state and the return valve 41 is brought into the opened state, the ink is returned from the ink receiving portion 19 to the ink containing chamber 33 by the supply of ink due to a negative pressure using the water head difference. At this time, the inside of the ink receiving portion 191 needs to communicate with the air so as to allow the ink receiving portion 19 to serve as the air communication port 23. If the first pump 43 is not provided, it is necessary to bring the return valve 41 into the closed state when the user injects ink into the ink containing chamber 33. This is because, if the inlet 21 is opened while the return valve 41 is maintained in the opened state, the ink contained in the ink containing chamber 33 may flow back to the ink receiving portion 19 via the buffer chamber 34. Further, in the present embodiment, the configuration in which the inlet 21 is provided on the ink tank 15 is described. However, the configuration including no inlet 21 is provided can be employed.

Figure 8A:
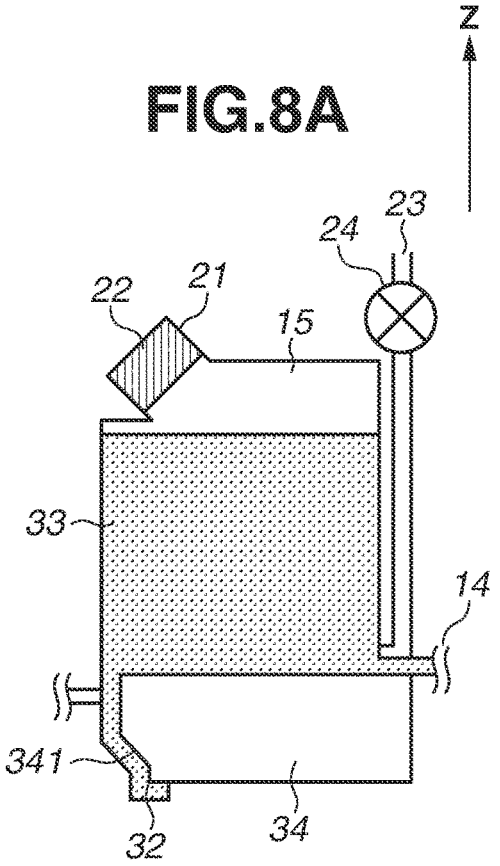
FIGS. 8A and 8B are sectional views schematically illustrating a major part of an ink tank of an inkjet recording apparatus according to a second embodiment.
Figure 8B:
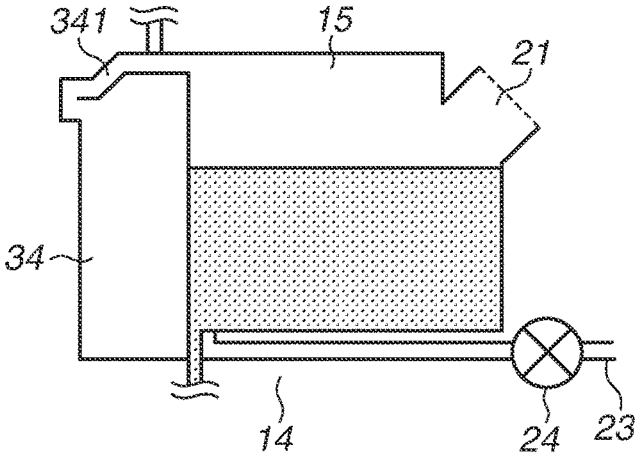

In a second embodiment, a configuration will be described in which beneficial effects similar to those of the first embodiment can be obtained without providing any valve or pump on the ink return path 191. FIGS. 8A and 8B are sectional diagrams each schematically illustrating a major part of the ink tank 15 according to the present embodiment. FIG. 8A illustrates a state where the recording operation is performed by the recording head 13. FIG. 8B illustrates a state where the user injects ink.

FIG. 8A illustrates a posture of the ink tank 15 when the user sets the ink tank 15 at a predetermined position of the recording apparatus 11. This posture is referred to as a first posture. When the ink tank 15 is set in the first posture, the recording apparatus 11 can execute the recording operation by the recording head 13.

In the present embodiment, when the user injects ink into the ink tank 15, the ink tank 15 is detached from the predetermined position of the recording apparatus 11, while the tube 51 and the like remain connected therewith. After that, the posture of the ink tank 15 is changed so that the inlet 21 faces upward in the vertical direction. The changed posture of the ink tank 15 as illustrated in FIG. 8B is referred to as a second posture. The user can detach the tank cap 22 after the posture of the ink tank 15 is changed to the second posture, to thereby inject ink into the ink containing chamber 33 from the inlet 21.

When the posture of the ink tank 15 is changed to the second posture by the user, the connection path 341 that connects the ink containing chamber 33 and the buffer chamber 34 is located at a vertically upper portion of the main body of the ink tank 15. Accordingly, the liquid surface of the ink contained in the ink containing chamber 33 is located vertically below the connection path 341, thereby preventing the ink from flowing out from the ink containing chamber 33 into the buffer chamber 34. Even when the ink tank 15 is in the second posture, the liquid surface of the ink contained in the ink containing chamber 33 is set to be lower than the ejection port surface 131 in the vertical direction. Therefore, it is also possible to prevent leakage of ink from each ejection port of the recording head 13 due to the water head difference when the user injects ink.

When the injection of ink is completed, the user covers the inlet 21 with the tank cap 22 and changes the posture of the ink tank 15 to the original posture (first posture). In the first embodiment, the ink tank 15 illustrated in FIGS. 4A to 4D is set in the first posture also when the user injects ink.

Figure 9C:
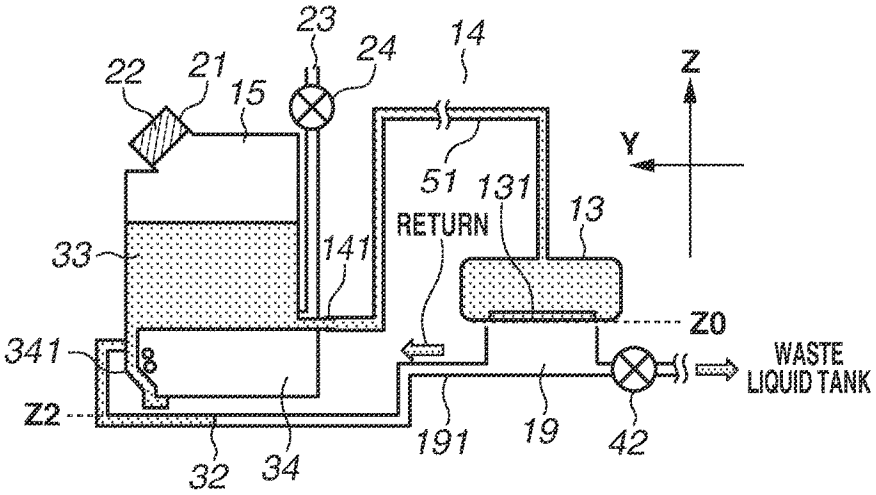
FIGS. 9A to 9C are sectional views schematically illustrating a flow of ink supplied from the ink tank to a recording head of the inkjet recording apparatus according to the second embodiment.
Figure 9A:
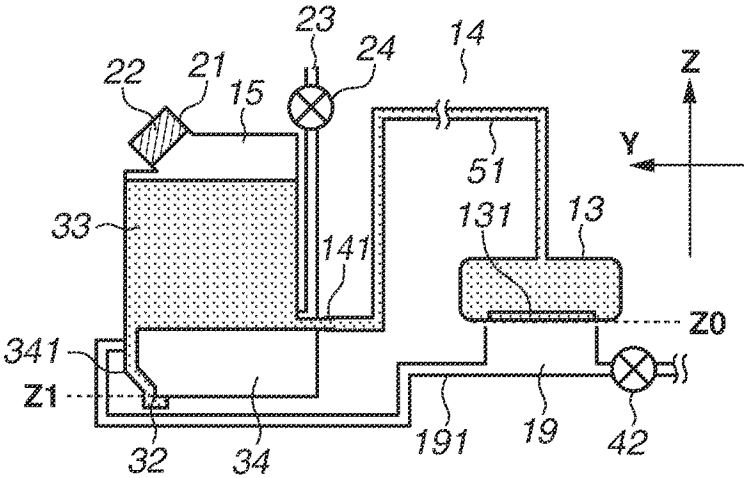
Figure 9B:
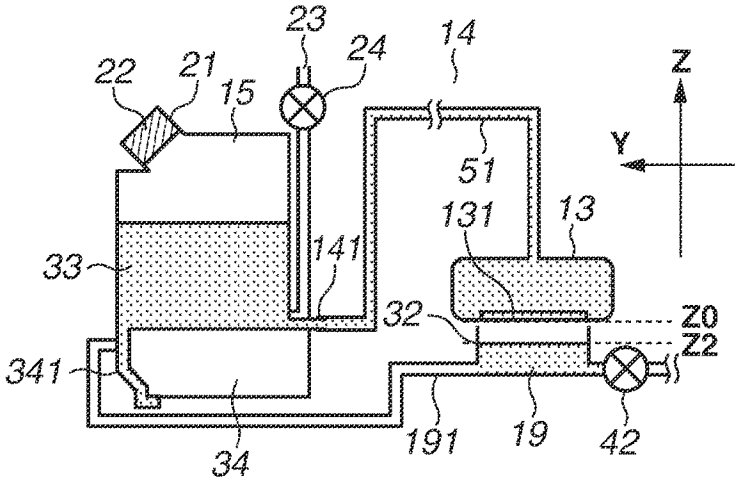

FIGS. 9A to 9C are sectional diagrams each schematically illustrating a flow of ink supplied from the ink tank 15 to the recording head 13 according to the present embodiment. In FIGS. 9A to 9C, the ink tank 15 is maintained in the first posture. FIG. 9A illustrates a first state (a state where the recording operation to be performed by the recording head 13 is ready) in the present embodiment. FIG. 9B illustrates a second state (a state where ink is accumulated in the ink receiving portion 19) in the present embodiment. FIG. 9C illustrates a third state (a state where ink is returned from the ink receiving portion 19 to the buffer chamber 34) in the present embodiment.

The ink accumulated in the ink receiving portion 19 illustrated in FIG. 9B is returned to the buffer chamber 34 by the supply of ink using a negative pressure of the water head difference system, and is then supplied to the ink containing chamber 33 through the connection path 341. Both in the second state and the third state, the height (Z2) of the boundary plane 32 between the ink and the air is lower than the height (Z0) of the ejection port surface 131, and the negative pressure applied to the ink on the ejection port surface 131 is maintained. Also in the present embodiment, as illustrated in FIGS. 9A to 9C, a configuration in which a path for discharging ink into the waste liquid tank with the discharge valve 42 is provided so that the ink can be selectively discharged may be employed.

In this way, also in the present embodiment, a stable ink supply can be achieved in a state where the water head difference of the ink is maintained. Even if the ink return path 191 is not provided with the return valve 41, the configuration in which the posture of the ink tank 15 is changed to the second posture in a case where the user injects ink can prevent the ink from flowing back to the ink receiving portion 19. Unlike in the first embodiment, there is no need to provide any valve or pump on the ink return path 191, which leads to a reduction in the number of components.

As a result, according to the present disclosure, it is possible to provide an ink recording apparatus capable of reducing the amount of ink to be wasted.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2017-037738, filed Feb. 28, 2017, which is hereby incorporated by reference herein in its entirety.

What is claimed is:

1. An inkjet recording apparatus comprising:

a recording head having an ejection port surface provided with a plurality of ejection ports for ejecting ink, and configured to perform a recording operation;

an ink receiving portion configured to receive the ink ejected from the plurality of ejection ports;

an ink storage container including:

an ink containing chamber configured to contain ink to be supplied to the recording head, an air communication port configured to communicate with air, and a buffer chamber that can temporarily retain ink, located below the ink containing chamber and provided between the ink containing chamber and the air communication port, the ink containing chamber, the air communication port, and the buffer chamber being integrally formed, and an ink return path configured to connect the ink receiving portion and the buffer chamber and cause the ink to be returned from the ink receiving portion to the buffer chamber.

2. The inkjet recording apparatus according to claim 1, wherein the ink storage container includes a connection path configured to connect the ink containing chamber and the buffer chamber, and an inlet through which ink is injected into the ink containing chamber, wherein the ink storage container is changeable between a first posture when the recording operation is performed by the recording head and a second posture when the ink is injected from the inlet, and wherein, when the ink storage container is in the first posture, the connection path is located below the ink storage container, and when the ink storage container is in the second posture, the connection path is located above the ink storage container.

3. The inkjet recording apparatus according to claim 1, wherein a filter is provided between the ink receiving portion and the ink containing chamber.

4. The inkjet recording apparatus according to claim 1, further comprising a first valve configured to be switchable between a state where the ink return path is opened and a state where the ink return path is closed.

5. The inkjet recording apparatus according to claim 4, further comprising a first pump configured to cause the ink to be returned from the ink receiving portion to the buffer chamber.

6. The inkjet recording apparatus according to claim 5, further comprising:

a waste liquid tank configured to contain ink discharged from the ink receiving portion;

a discharge path configured to connect the ink receiving portion and the waste liquid tank;

a second valve configured to be switchable between a state where the discharge path is opened and a state where the discharge path is closed; and a second pump configured to discharge ink from the ink receiving portion to the waste liquid tank.

7. The inkjet recording apparatus according to claim 6, wherein the recording head performs a preliminary discharge operation for ejecting ink that does not contribute to the recording operation to the ink receiving portion and, in a case where the ink receiving portion receives the ink ejected in the preliminary discharge operation, the first pump is driven to return the ink to the buffer chamber in a state where the first valve is opened and the second valve is closed.

8. The inkjet recording apparatus according to claim 6, wherein the inkjet recording apparatus is capable of performing an initial filling operation for filling a space ranging from the ink containing chamber to the recording head with ink, and the initial filling operation is performed by driving the first pump in a state where the first valve is opened and the second valve is closed.

9. The inkjet recording apparatus according to claim 6, wherein the ink receiving portion is a cap capable of capping the ejection port surface and, in a case where the ejection port surface is capped with the cap to perform a suction recovery operation, the second pump is driven in a state where the first valve is closed and the second valve is opened, to discharge ink into the waste liquid tank.

10. The inkjet recording apparatus according to claim 1, wherein the recording head includes a black ejection port surface configured to eject black ink and a color ejection port surface configured to eject color ink, and wherein the ink receiving portion includes a black cap configured to cap the black ejection port surface, and a color cap configured to cap the color ejection port surface.

11. The inkjet recording apparatus according to claim 10, further comprising:

an ink return path configured to connect the black cap and the buffer chamber; and a discharge path configured to connect the black cap and the waste liquid tank, wherein, when the black cap is connected to the ink return path, ink is returned to the buffer chamber, and when the black cap is connected to the discharge path, ink is discharged into the waste liquid tank.

12. The inkjet recording apparatus according to claim 10, further comprising a discharge path configured to connect the color cap and the waste liquid tank, wherein ink contained in the color cap is discharged into the waste liquid tank through the discharge path.

13. The inkjet recording apparatus according to claim 10, wherein the color ink includes at least one of cyan ink, magenta ink, and yellow ink.

14. A method for an inkjet recording apparatus having an ink storage container that includes an ink containing chamber, an air communication port, and a buffer chamber located below the ink containing chamber and provided between the ink containing chamber and the air communication port, the method comprising:

performing a recording operation via a recording head having an ejection port surface provided with a plurality of ejection ports for ejecting ink;

receiving, via an ink receiving portion, the ink ejected from the plurality of ejection ports;

containing ink, to be supplied to the recording head, in the ink containing chamber;

communicating, via the air communication port, with air;

temporarily retaining ink in a buffer chamber integrally formed in the ink storage container; and causing, via an ink return path configured to connect the ink receiving portion and the buffer chamber, the ink to be returned from the ink receiving portion to the buffer chamber.

* * * * *